US006857250B1

(12) United States Patent
Taylor

(10) Patent No.: US 6,857,250 B1
(45) Date of Patent: Feb. 22, 2005

(54) MECHANISM FOR APPLYING A ROLLER FORMED CLOSURE TO A CONTAINER

(75) Inventor: Douglas F. Taylor, Toledo, OH (US)

(73) Assignee: Canberra Corporation, Toledo, OH (US)

( * ) Notice: Subject to any disclaimer, the term of this patent is extended or adjusted under 35 U.S.C. 154(b) by 0 days.

(21) Appl. No.: 10/752,730

(22) Filed: Jan. 7, 2004

(51) Int. Cl.[7] ..... B65B 7/28

(52) U.S. Cl. ..... 53/331; 53/133.2; 53/471; 53/478; 53/485

(58) Field of Search ..... 53/331, 133.2, 53/317, 325, 334, 264, 359, 341; 220/309.1; 215/327

(56) References Cited

U.S. PATENT DOCUMENTS

| | | | | | |
|---|---|---|---|---|---|
| 938,325 | A | * | 10/1909 | Krummel | 53/339 |
| 1,170,598 | A | * | 2/1916 | Beadle | 53/334 |
| 1,452,410 | A | * | 4/1923 | Boucher | 53/340 |
| 1,560,059 | A | * | 11/1925 | Johnson | 53/339 |
| 3,775,944 | A | * | 12/1973 | Roberts | 53/334 |
| 3,895,478 | A | * | 7/1975 | Friendship | 53/77 |
| 3,921,366 | A | | 11/1975 | Coop | |
| 3,964,234 | A | | 6/1976 | Hurst | |
| 4,075,820 | A | * | 2/1978 | Standley | 53/329.4 |
| 4,087,952 | A | | 5/1978 | Spies | |
| 4,099,361 | A | | 7/1978 | Dix et al. | |
| 4,232,500 | A | | 11/1980 | Holstein | |
| 4,356,680 | A | | 11/1982 | Guest | |
| 4,466,548 | A | | 8/1984 | Herbert | |
| 4,511,044 | A | | 4/1985 | Connor et al. | |
| 4,555,208 | A | | 11/1985 | Houdayer et al. | |
| 4,628,669 | A | | 12/1986 | Herron et al. | |
| 4,749,096 | A | | 6/1988 | Thomas et al. | |
| 5,111,635 | A | | 5/1992 | Neber | |
| 5,207,048 | A | * | 5/1993 | Wysocki | 53/133.2 |
| 5,237,797 | A | * | 8/1993 | Varlet | 53/420 |
| 5,533,317 | A | | 7/1996 | Galandrino | |

* cited by examiner

*Primary Examiner*—Rinaldi I. Rada
*Assistant Examiner*—Thanh Truong
(74) *Attorney, Agent, or Firm*—Fraser Martin Buchanan Miller LLC; Donald R. Fraser

(57) ABSTRACT

Mechanism for applying a roller forming closure to a container is disclosed wherein the closure is provided, with an integral fitment including a fluid discharge pump and an associated discharge line.

6 Claims, 7 Drawing Sheets

MECHANISM FOR APPLYING A ROLLER FORMED CLOSURE TO A CONTAINER

BACKGROUND OF THE INVENTION

1. Field of the Invention

The present invention relates generally to a mechanism for applying a closure to a container and, more particularly, to a mechanism for applying a roller formed closure, including an integral fitment such as a pump, to a container.

2. Description of the Prior Art

It is generally known to apply a closure to the finish of a container to provide a seal therefrom. It is also known to apply the closure to the finish by means of a single roller forming process wherein the edge of the closure placed on the open neck of the finish of the container is flanged against the outer surface of the finish. However, in instances where the closure for the container is designed to include an integral fitment, such as a pump for discharging the fluid contained within the container, the application of the assembly included several sequential steps.

It is an object of the present invention to produce a mechanism and associated process for applying a roller formed closure including an integral fitment to the finish of a container in a single step.

Another object of the invention is to produce a mechanism and method for applying a roller formed closure including a novel chuck structure adapted to apply a closure and an integral fitment to the finish of a container in a single operating step.

SUMMARY OF THE INVENTION

The above objects may surprisingly be achieved by a mechanism for applying a roller formed closure and associated fitment to the finish of a container comprising a support for the container wherein the container is supported thereon with the finish of the container extending in a direction away from the support; a chuck body for holding a closure and integral fitment extending outwardly therefrom for application to the finish of the container, the chuck body including a closure retaining cavity wherein a portion of the closure extends beyond the cavity and an associated opening in the body for receiving the fitment; means for effecting movement of the chuck body toward and away from the support to enable the chuck body and a closure and integral fitment to be positioned on the finish of a container disposed on the support; closure roller forming tooling mounted for selective movement to contact the portion of the closure extending beyond the cavity of the chuck body; and means for effecting relative rotation of the support and the chuck body to permit the closure roller forming tooling to crimp the closure into intimate sealing relation with the finish of the container.

BRIEF DESCRIPTION OF THE DRAWINGS

The above objects and advantages of the invention will become readily apparent to those skilled in the art from reading the following detailed description of a preferred embodiment of the invention when considered in the light of the accompanying drawings, in which.

DETAILED DESCRIPTION OF THE PREFERRED EMBODIMENT

Figure 1:
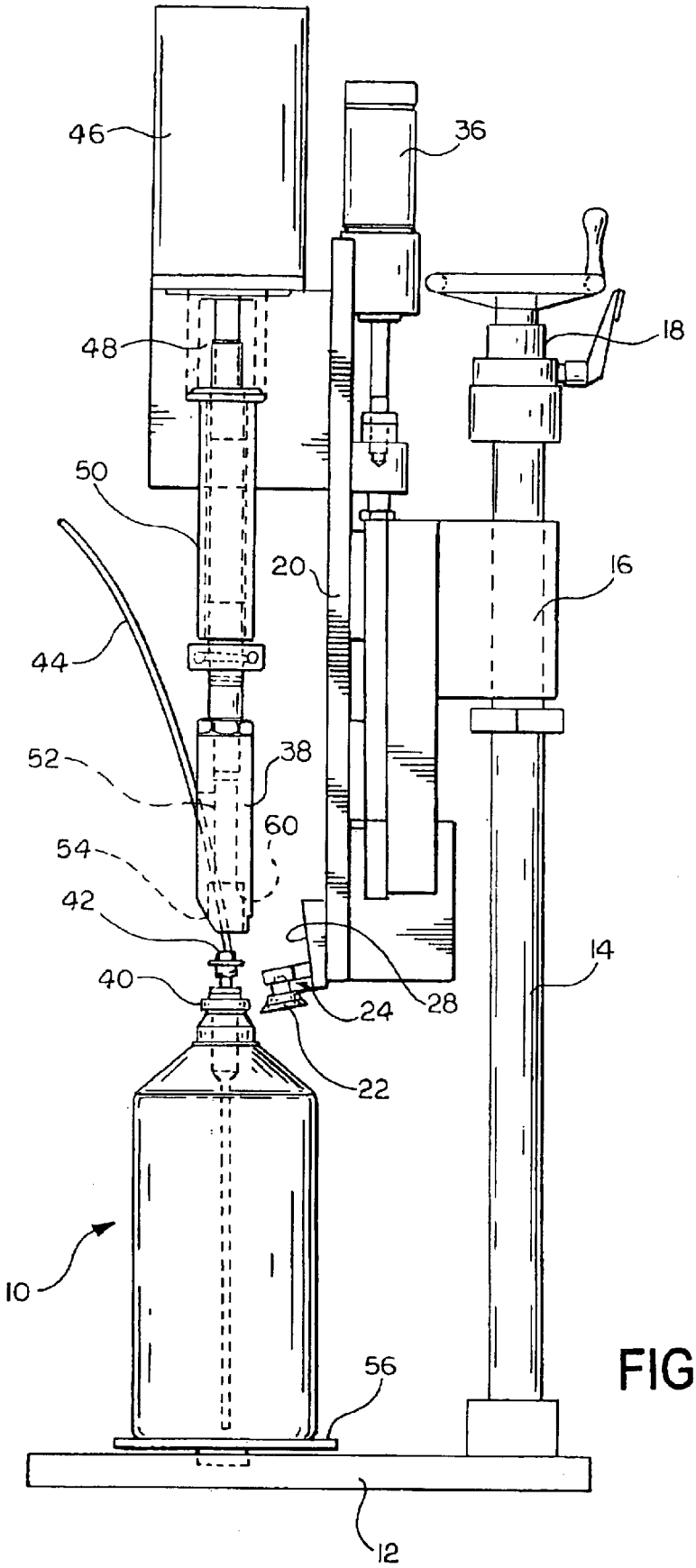
FIG. 1 is an elevational view of a mechanism for applying roller formed closure to a container incorporating the features of the present invention.
Figure 2:
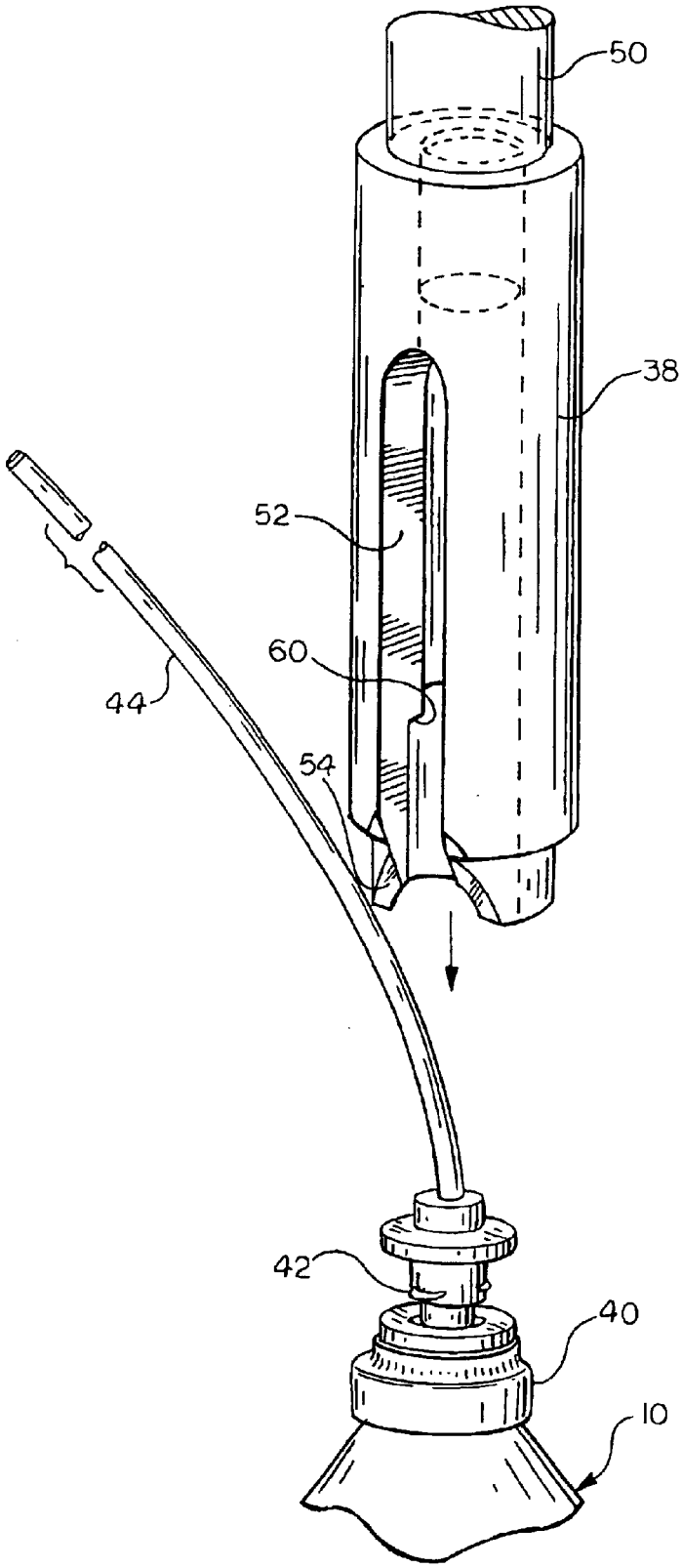
FIG. 2 is an enlarged fragmentary perspective view of the closure manipulating chuck and closure illustrated in FIG. 1.
Figure 3:
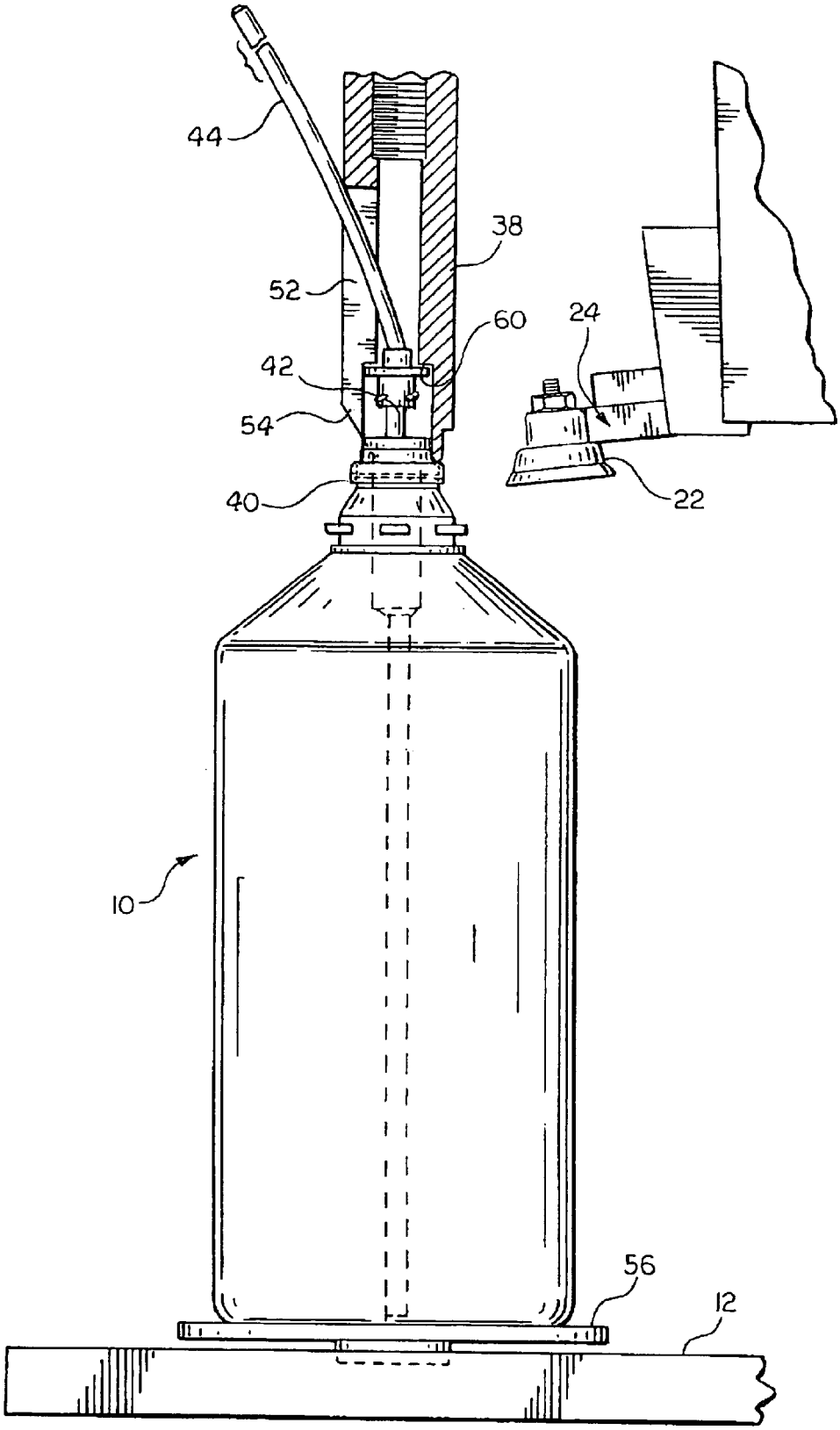
FIG. 3 is an enlarged fragmentary view partially in the section of the mechanism illustrated in FIG. 1 with the closure manipulating chuck in an operative position with the closure adjacent the open end of finish of the container.

Referring to the drawings, there is illustrated a mechanism for roller forming a closure on a container wherein the closure contains an integral fitment including a pumping mechanism for discharging liquid contained within the associated container.

More particularly, there is illustrated in the drawings, and particularly in FIG. 1, a mechanism for roller forming a closure to the open neck finish of container indicated generally by reference numeral 10.

The mechanism includes a base 12 having an upstanding columnar support 14. A vertically adjustable collar 16 is mounted to be selectably positioned along the longitudinal axis of the support 14 by any commercially available lead screw adjustment mechanism 18, for example.

Mechanism for applying a closure to the container 10 by roller forming an annular skirt of the closure cap against an external conformation on the neck finish of the container is supported for vertical adjustment on the collar 16. A vertically extending mounting member 20 is affixed to the collar 16. A profile wheel 22 is mounted to the distal end of a pivotally mounted arm 24. The arm 24 is pivotally mounted at 26 to a bracket 28 affixed to the mounting member 20. The opposite end of the arm 24 is pivotally coupled to a reciprocating rod 30 of an actuating cylinder 32 which, in turn, is pivotally coupled to the member 20 through a bracket 34. It will be appreciated that the reciprocating movement of the control rod 30 will effectively cause pivotal movement of the support arm 24 about the pivot 26 causing selective to and from movement of the profile wheel 22 into and out of operative position, as will be explained in greater detail hereinafter. The movement of the support arm 24 is controlled by the admission of pressure fluid into and out of the cylinder 32. The pressure fluid typically emanates from the pressure fluid source 36 through conventional conduits and associated valves, not illustrated. The pressure fluid utilized in the preferred embodiment is air.

A chuck body 38 for holding a ferrule or closure 40 and an integral fluid pump assembly 42 and an associated discharge line 44 is mounted for reciprocal vertical rotational movement in respect of the mounting member 20. The reciprocating rotational movement of the chuck body 38 is achieved by a servo mechanism 46 which includes a DC electric motor for effecting rotation of a shaft 48 and an associated pneumatically actuated telescoping extendible tube 50 attached to the shaft 48. The terminal end of the telescoping extensible tube 50 is adapted to be threadably engaged to the upper end of the chuck body 38.

The chuck 38 is typically tubular in form and is internally threaded at one end to receive the externally threaded end of the tube 50 and is open at the opposite end to receive and apply downward pressure on the closure 40 to be formed on the container 10. The side of the chuck body-38 is formed with a longitudinally extending slot 52 which extends in parallel relation to the longitudinal axis of the cylindrical chuck body 38. The slot 52 has an opening defined a pair of cooperating generally V-shaped walls 54 which cooperate to assist in guiding the fluid discharge tube 44 of the discharge pump 42 of the ferrule 40 when the chuck body 38 is moved downwardly into operative position.

The base 12 of the mechanism includes a container support plate 56 for rotably supporting the bottom of the container 10 and permitting the container 10 to rotate relative to the base 12 about the center axis of the container 10. In the supported position, it will be observed that hollow interior of the chuck body 38 is provided with an annular inwardly extending shoulder 60 against which an annularly outwardly extending portion of the pump 42 of the ferrule 40 may rest and militate against any linear movement of the ferrule 40 and the associated pump 42.

In operation, the mechanism illustrated in FIGS. 1 through 8 may be utilized to apply roller formed closures to containers used for supplying liquid soap to the soap dispensers typically installed in the restrooms of public facilities such as movie theaters, restaurants, sports arenas, and the like where a considerable supply of liquid soap is required and used. In such establishments, a hand operated plunger or lever is mounted in the immediate vicinity of the wash basins in the restrooms. The plunger or lever is attached to a reciprocating pump mechanism integral with the soap container normally stored beneath the wash basin out of sight of the users of the facilities. Integral with the pump mechanism is an extended plastic discharge tube, the outlet end of which is in communication with a soap discharge nozzle located in the vicinity of the actuating plunger or lever to facilitate the application of soap to the hands of the user.

The fabrication and assembly of the closure for the soap container 10 is the primary concern of the present invention. Heretofore, when it was desired to assemble a closure on a container wherein the closure was designed to include an upstanding fitment such as a pump, for example, the closure is initially applied in a first step and then subsequent to the first step, the auxiliary fitment is applied in a separate second step. The two-step process has been deemed necessary due to the previous inability to apply a closure and integral fitment in a single step operation. The present invention through the development of a unique closure roller forming ferrule manipulating chuck, surprisingly the single step operation has been made possible.

Figure 7:
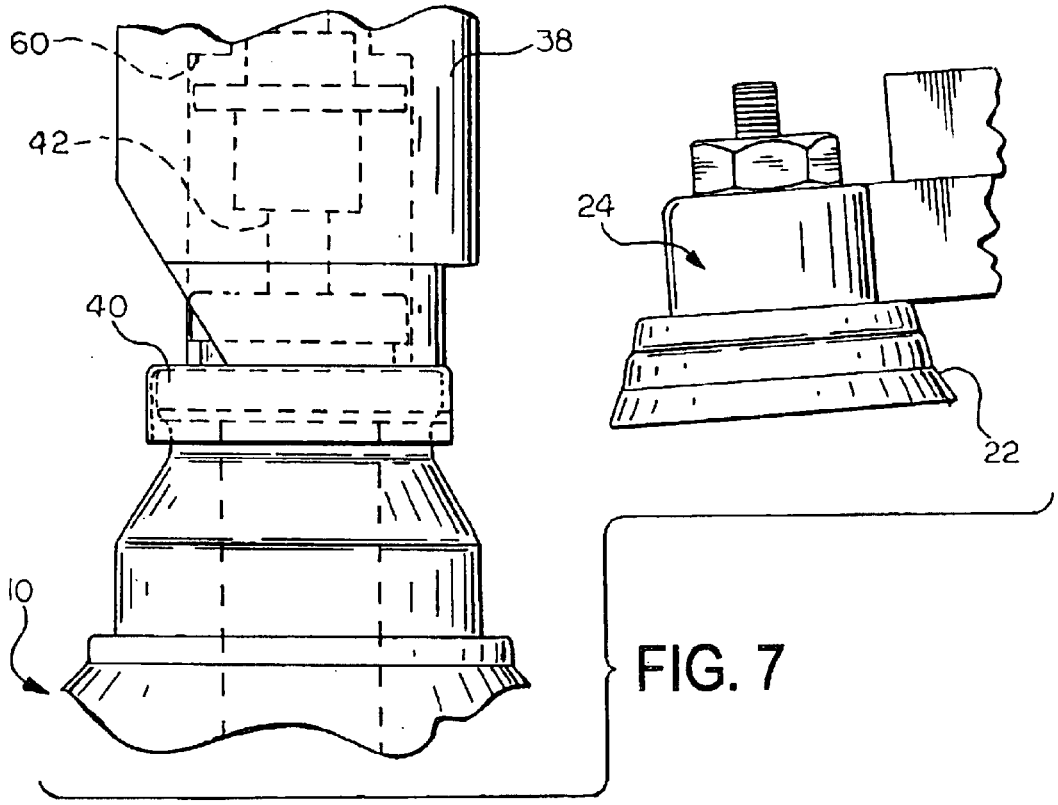
FIG. 7 is an enlarged fragmentary view of the closure manipulating chuck and the associated profile wheel as illustrated in FIG. 3.
Figure 8:
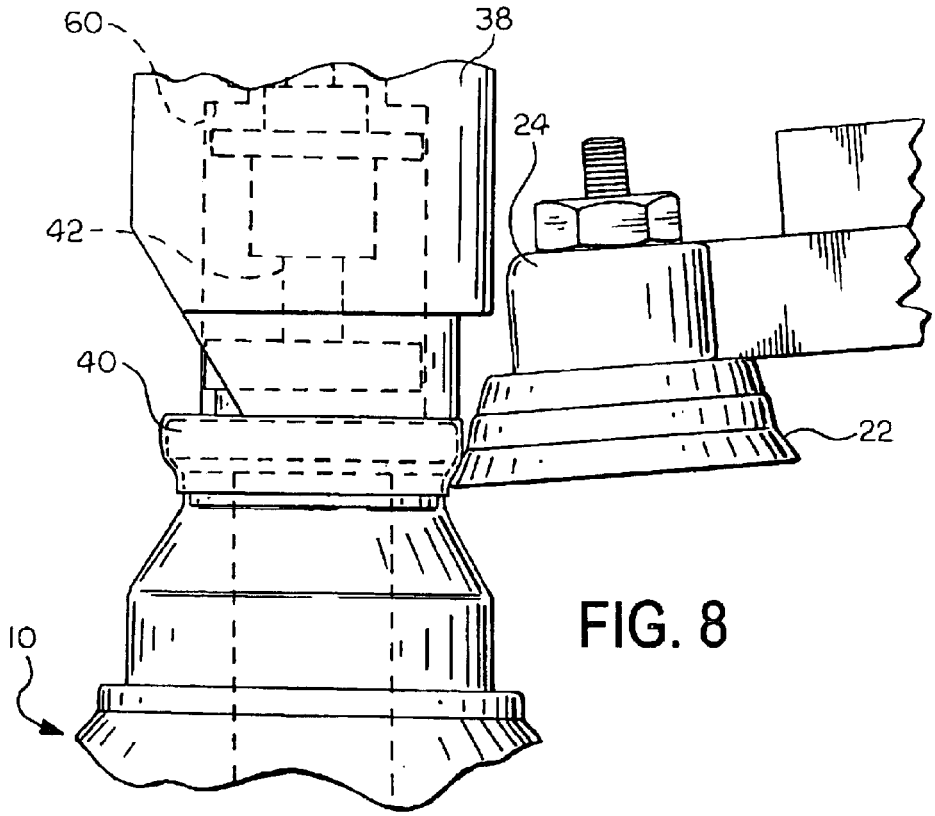
FIG. 8 is an enlarged fragmentary view similar to FIG. 7 with the profile wheel in operative contact with the closure forming ferrule.

In initiating the closure forming operation, the mechanism is positioned as illustrated in FIG. 1. The container 10, to be provided with a closure and associated fitment, is disposed on the revolvable plate 56 with the ferrule 40 to be formed, the pump 42, and the discharge line 44 extending upwardly. The chuck body 38 is lowered causing entry of the discharge tube 44 into the slot 52 by the constant guidance of the tube 44 through the slot V-shaped entry 54. Finally, the lower terminal end of the chuck body 38 is firmly positioned against the upper outer annular surface of the closure forming ferrule 40, as illustrated in FIGS. 4 and 7.

Figure 4:
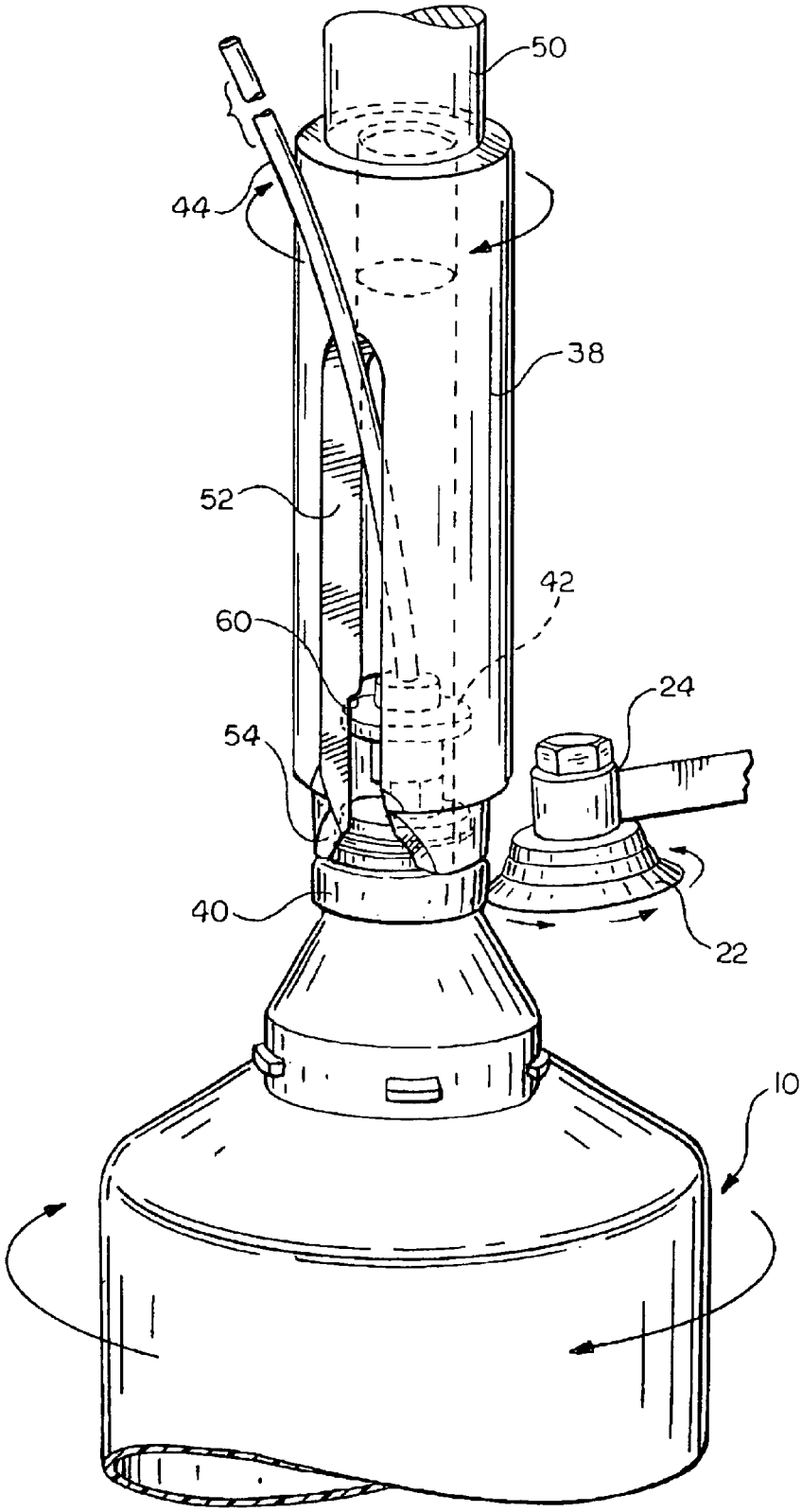
FIG. 4 is an enlarged fragmentary view of the mechanism illustrated in FIG. 2 showing the profile wheel in a roller forming position in contact with the lower edge of the closure forming ferrule.
Figure 5:
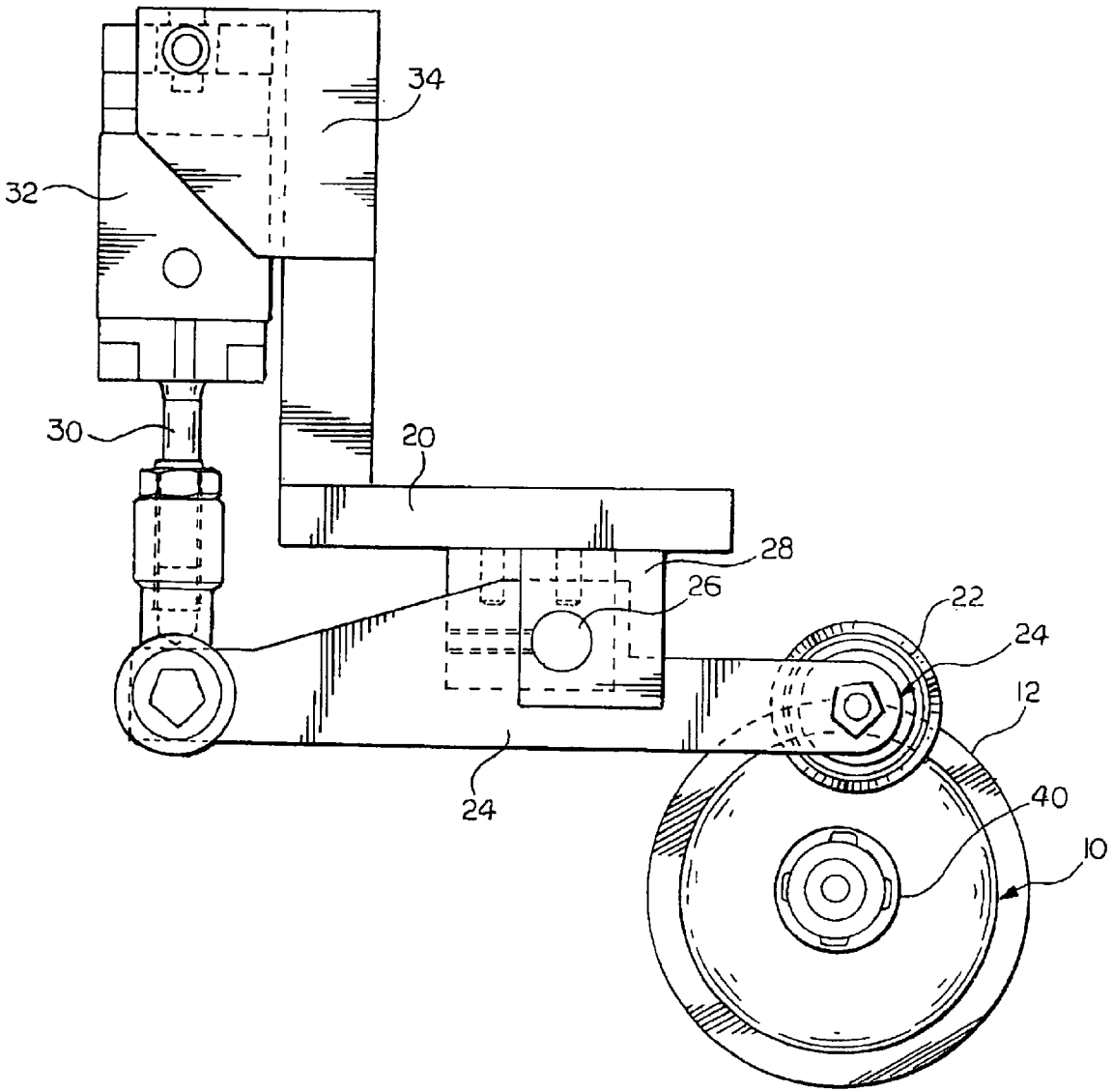
FIG. 5 is a top plan view of the mechanism illustrated in FIGS. 1 and 3.
Figure 6:
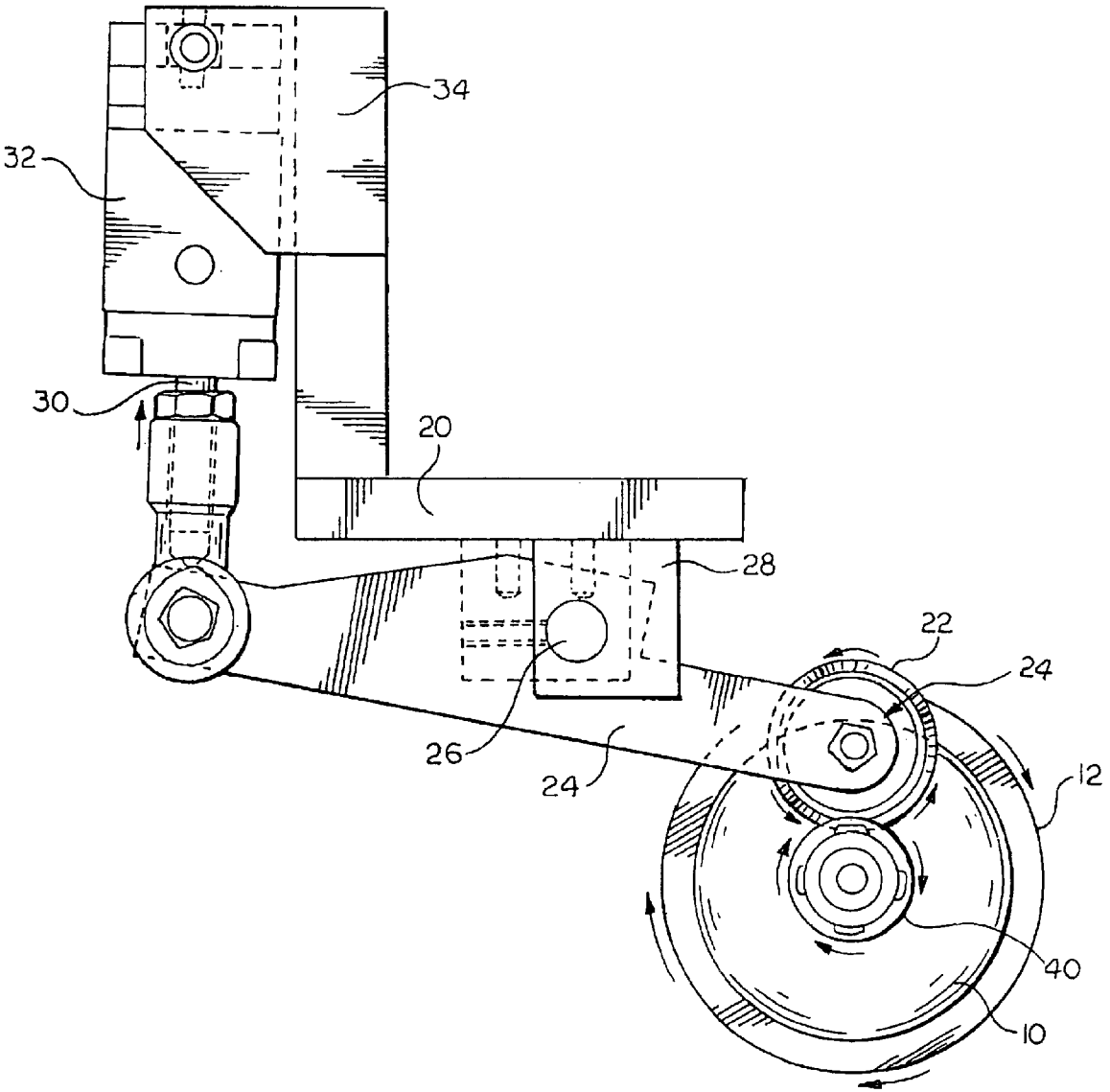
FIG. 6 is a top plan view of the mechanism illustrated in FIG. 4 wherein the profile wheel is in operative position against the closure forming ferrule.

Next, in sequence, the profile wheel 22 is caused to be moved by the pivotal support arm 24 from the position illustrated in FIGS. 1, 3, 5, and 7 to the position illustrated in FIGS. 4, 5 and 6. In the latter position, the outer edge of the profile wheel 24 is in contact with the lower portion of the depending skirt of the annular ferrule 40.

Then the motor 46 causes the chuck body 38 and the associated container 10 and ferrule with the pump 42 and discharge tube 44 to rotate with the rotatable plate 56. This rotational movement is relative to the profile wheel 22. During the relative rotational movement and the constant inward pressure of the profile wheel 22 against the lower portion of the depending skirt of the ferrule 40, the skirt is roller formed into tight intimate sealing relation with the outer surface of the finish of the neck of the container 10 as clearly illustrated in FIG. 8.

It will be understood that as the roller forming operation progresses, the discharge tube 44 is caused to travel around the longitudinal axis of the chuck body 38 and the container 10.

Upon completion of the roller forming operation explained above, the support arm 24 is caused to be pivoted about the pivot point 26 by the withdrawal of the actuating rock 30 by the cylinder 32, and the motor 46 ceases rotation of the chuck body 38 and associated closure sealed container 10., and the chuck body 38 is raised allowing removal of the completed closed container 10 with the now integral pump 42 and the discharge tube 44 for packaging and shipment.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A mechanism for applying roller formed closure and associated fitment having a discharge line to the finish of a container comprising:

a support for the container wherein the container is supported thereon to rotate about an axis with the finish of the container extending in a direction away from said support;

a chuck body having a longitudinal axis for holding a closure and integral fitment extending outwardly therefrom for application to the finish of the container, said chuck body having a hollow interior terminating in a closure retaining cavity wherein a portion of the closure extends beyond the cavity and an associated longitudinally extending slot terminating in generally V-shaped walls in said chuck body for receiving and guiding the discharge line of the fitment;

means for effecting movement of said chuck body toward and away from said support to enable said chuck body and a closure and integral fitment to be firmly positioned on the finish of a container disposed on said support;

closure roller forming tooling mounted for selective linear movement toward and away from said chuck body to contact the portion of the closure extending beyond the cavity of said chuck body; and means for effecting rotation of said chuck body and the associated container relative to said closure roller forming tooling to permit said closure roller forming tooling to crimp the closure into intimate sealing relation with the finish of the container and permitting unimpeded rotation of the fitment and discharge line about the longitudinal axis of said chuck body.

2. The mechanism defined in claim 1 wherein said support includes a plate for supporting a container.

3. The invention defined in claim 1 wherein said support includes a rotatable plate.

4. The mechanism defined in claim 1 wherein said chuck body is cylindrical in shape.

5. The mechanism defined in claim 1, wherein the hollow interior portion of said chuck body includes means to militate against movement of the closure and fitment.

6. The mechanism defined in claim 5, wherein said means to militate against movement of the closure and fitment includes an inwardly extending shoulder.

* * * * *